US005147108A

United States Patent [19]

LaPointe

[11] Patent Number: 5,147,108

[45] Date of Patent: Sep. 15, 1992

[54] RECLINING SOFA

[75] Inventor: Larry P. LaPointe, Temperance, Mich.

[73] Assignee: La-Z-Boy Chair Company, Monroe, Mich.

[21] Appl. No.: 600,181

[22] Filed: Oct. 18, 1990

[51] Int. Cl.[5] ..... A47C 1/02

[52] U.S. Cl. ..... 297/85; 297/84; 297/68; 297/318; 297/329

[58] Field of Search ..... 297/68, 84, 85, 318, 297/329

[56] References Cited

U.S. PATENT DOCUMENTS

| | | | |
|---|---|---|---|
| 4,072,342 | 2/1978 | Johnson et al. | 297/318 X |
| 4,202,580 | 5/1980 | Johnson | 297/84 |
| 4,367,895 | 1/1983 | Pacitti et al. | 297/85 |
| 4,531,778 | 7/1985 | Rogers, Jr. | 297/318 X |

*Primary Examiner*—Kenneth J. Dorner
*Assistant Examiner*—Milton Nelson, Jr.
*Attorney, Agent, or Firm*—Harness, Dickey & Pierce

[57] ABSTRACT

A "three-way" recliner mechanism for use in a sofa or loveseat type of article of furniture is disclosed. The present invention is a "zero wall proximity" recliner mechanism which is fully reclinable within the confines of its stationary frame assembly. The recliner mechanism provides operative linkages for "tilting" the seat unit, "reclining" the seat back relative to the seat frame and for extending and retracting a leg rest assembly. The present recliner mechanism has a short stroke drive assembly having an actuator lever, concealed in the upholstery of the sofa or loveseat, which may be easily operated by the seat occupant to concurrently operate the leg rest assembly and generate "tilting" movement of the reclinable seat unit.

27 Claims, 9 Drawing Sheets 14
16B
16A
106
106

14
16A
106
16B
18

16B
14
16A
106
18
106
18

20
17
16A
106
16B
106
18
18

20
17
16B
16A
106
106

20
17
16B
16A
106
18
106
18

RECLINING SOFA

BACKGROUND FOR THE INVENTION

The present invention relates to furniture and, more particularly, to an improved reclining mechanism for articles of furniture such as chairs, sofas and loveseats.

Most conventional reclining seat sections in chairs, sofas, loveseats and the like, typically require a predetermined distance between an adjacent wall surface and the seat back to avoid contact therebetween during reclined operation. In addition, most reclining seat sections are generally not associated with loose seat cushions due to the height requirements of the mechanical recliner mechanism confined under the seat.

Reclining mechanisms typically generate a relatively large amount of frictional drag which must be overcome for smooth movement between an "upright" and a "tilted" position. In particular, lighter weight seat occupants must normally exert a deliberate leveraged thrust or force, in addition to pulling the actuator lever, for completely extending the leg rest and moving the seat section to its "tilted" position. Moreover, it is often difficult for the seat occupant to return to the upright position from the "tilted" or a fully "reclined" position due to the height and the upward angular tilt of the seat relative to the reclined seat back. As such, the occupant must exert a relatively large and deliberate leveraged force to return the reclined seat section to the full upright position. Another drawback associated with recliners is that the leg rest assembly cannot be retracted to its stowed position from an extended elevated position until after the seat occupant has completely returned the seat section to its fully upright position.

SUMMARY OF THE INVENTION

In accordance with the principles of the present invention, an improved reclining type article of furniture is disclosed which is designed to overcome the disadvantages associated with prior art recliners.

Accordingly, it is an object of the present invention to provide a recliner mechanism which permits the chair, sofa or loveseat to be placed directly against an adjacent wall surface without the necessity of providing a space therebetween. As such, the present invention is a "zero wall proximity" recliner mechanism which is fully reclinable within the confines of its stationary frame assembly.

It is an additional object of the present invention to provide a compact three-way recliner which permits use of loose cushions therewith. The "three-way" recliner provides operative linkages for "tilting" the seat unit, "reclining" the seat back relative to the seat frame and for extending and retracting the leg rest assembly.

It is another object of the present invention to reduce the input force exerted by the operator for smoother operation of the reclining mechanism. As a related object, the improved recliner mechanism has incorporated various linkage and drive components designed for substantially reducing frictional losses in an effort to promote easier actuation. Furthermore, the retracting movement of the leg rest assembly is utilized to assist in completely returning the seat unit to the "upright" position.

It is also a purpose of this invention to provide a reclining seat unit wherein the weight of the person occupying the seat unit is utilized as means to assist in moving a seat assembly from the "upright" position to the "tilted" and/or "reclined" positions and, while concurrently acting to assist in moving the leg rest assembly from a stored position to an elevated and operative position.

Another purpose of the invention is to provide a shortstroke drive assembly having an actuator lever, concealed in the upholstery, which may be easily operated by the seat occupant to concurrently operate the leg rest assembly and generate "tilting" movement of the seat assembly. In a preferred embodiment of the present invention, a sofa or loveseat has a leg rest assembly which is operated by the seat occupant rotating the actuator lever through a limited angle which, in turn, rotates a drive rod assembly for actuating the leg rest linkage. An over-center toggle mechanism is provided to assist in extending and retracting the leg rest assembly and in retaining the leg rest assembly in its "stowed" position. IN addition, the drive rod assembly concurrently operates a drive linkage mechanism for "tilting" the seat unit relative to a stationary base assembly. Moreover, the included angle between the seat back and seat frame of the seat assembly remains substantially constant through out the "tilting" movement. Following the "tilting" movement, the seat assembly can be additionally "reclined" by applying pressure to the seat back for increasing the included angle between the seat back and the seat frame. Therefore, "tilting" and "reclining" of the seat unit are independent of each other and are generally cumulative to define a "fully" reclined position.

In accordance with the present invention, forward movement of the seat unit relative to the base assembly is required prior to "reclining" movement of the seat back to compensate for rearward movement of the seat back so as to maintain a substantially constant clearance between the seat back of the seat unit and the adjacent wall surface. Furthermore, the "reclining" movement is easily initiated by the seat occupant by simply leaning his body to apply or remove pressure from the seat back. Due to the reduced frictional drag of the improved recliner mechanism, it is not necessary for the seat occupant to apply additional leverage with his arms or feet following sufficient rotation of the concealed actuator lever to continue the desired movement. In addition, "tilting" of the sofa or loveseat in conjunction with concurrent actuation of the leg rest assembly contributes significantly to the ease and smoothness of operation and also provides an added increment of comfort and consumer satisfaction.

Additional objects, advantages, and features of the present invention will become apparent from the following description and appended claims, taken in conjunction with the accompanying drawings.

Figure 3:
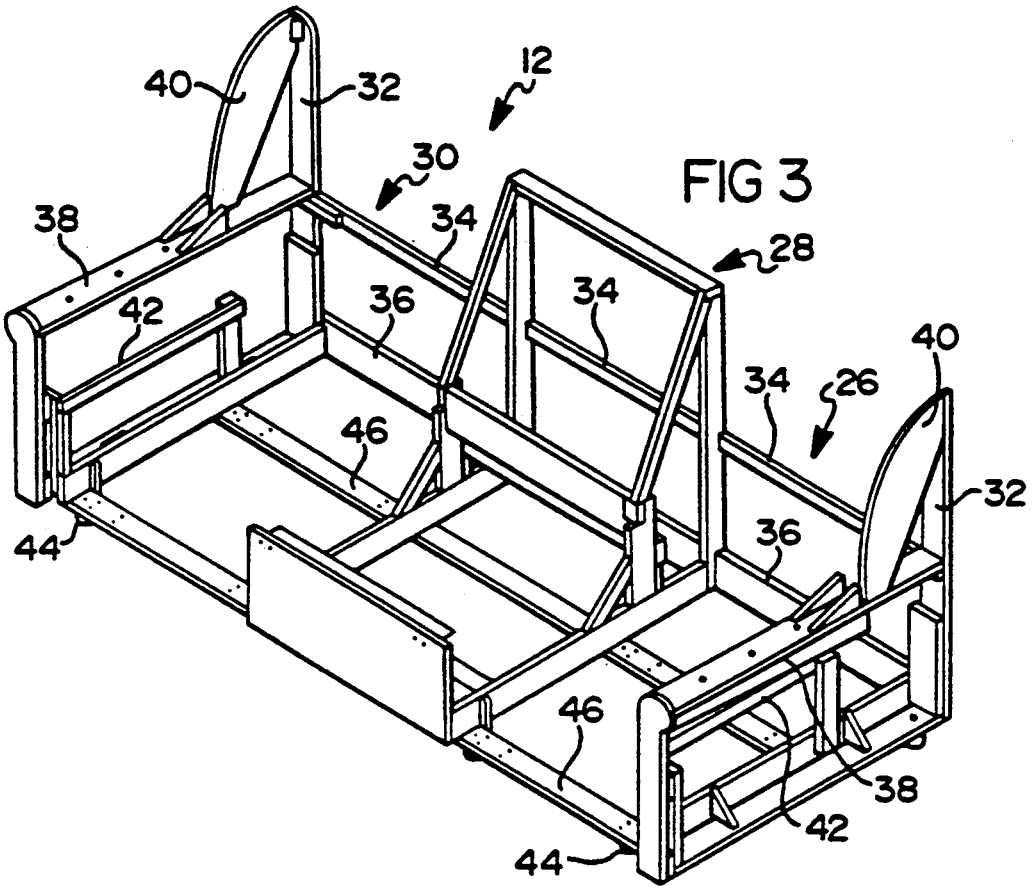
FIG. 3 is a perspective view of a frame assembly (with upholstery removed) for the sofa unit of FIGS.
Figure 11A:
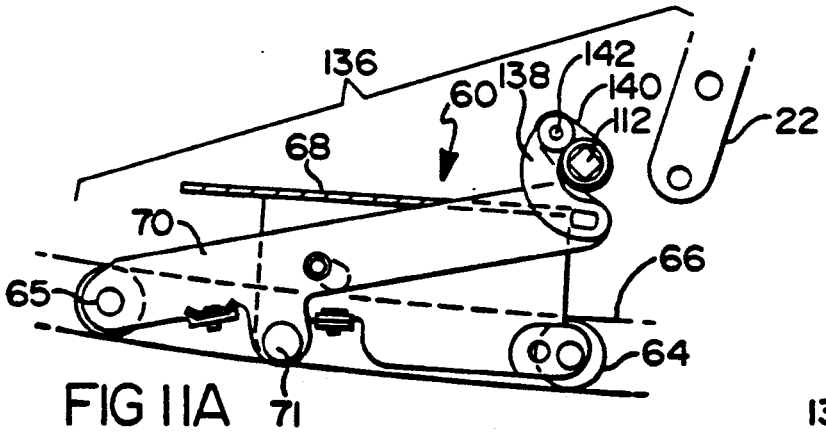
Figure 11B:
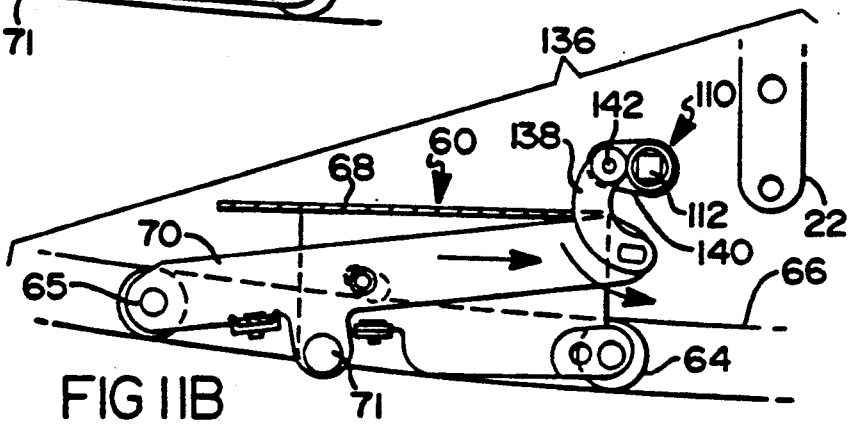
Figure 4:
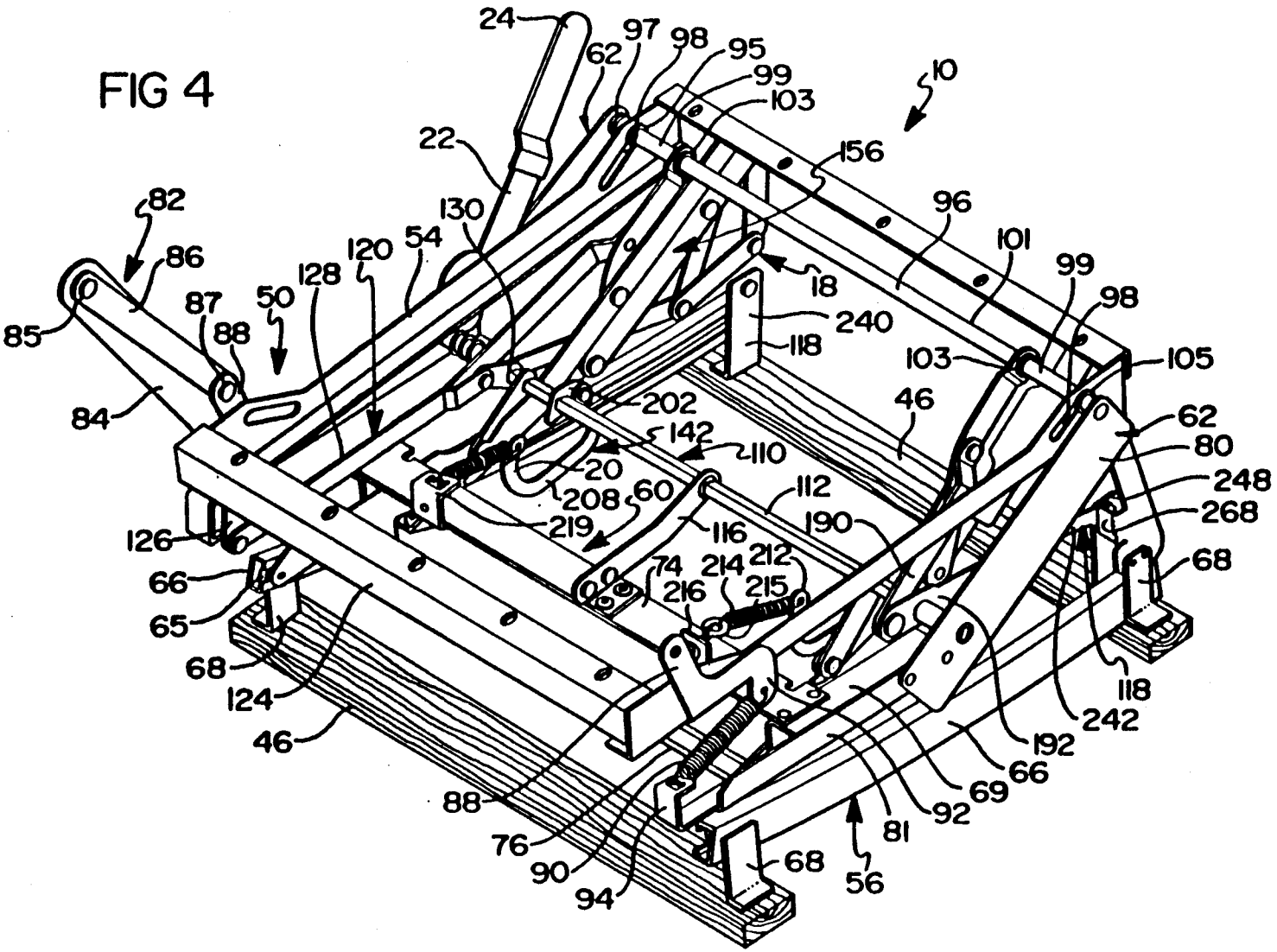
Figure 5:
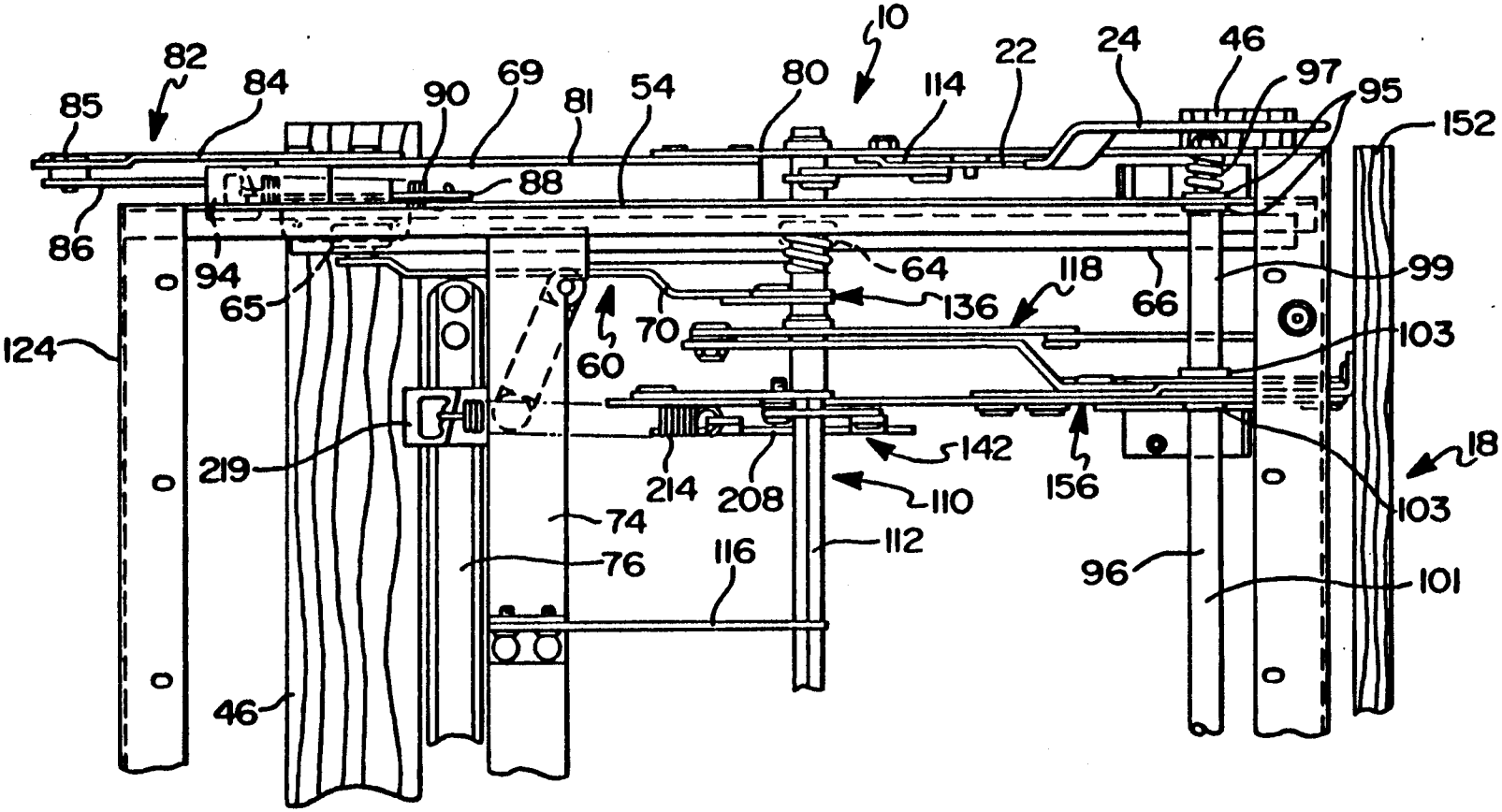
Figure 6:
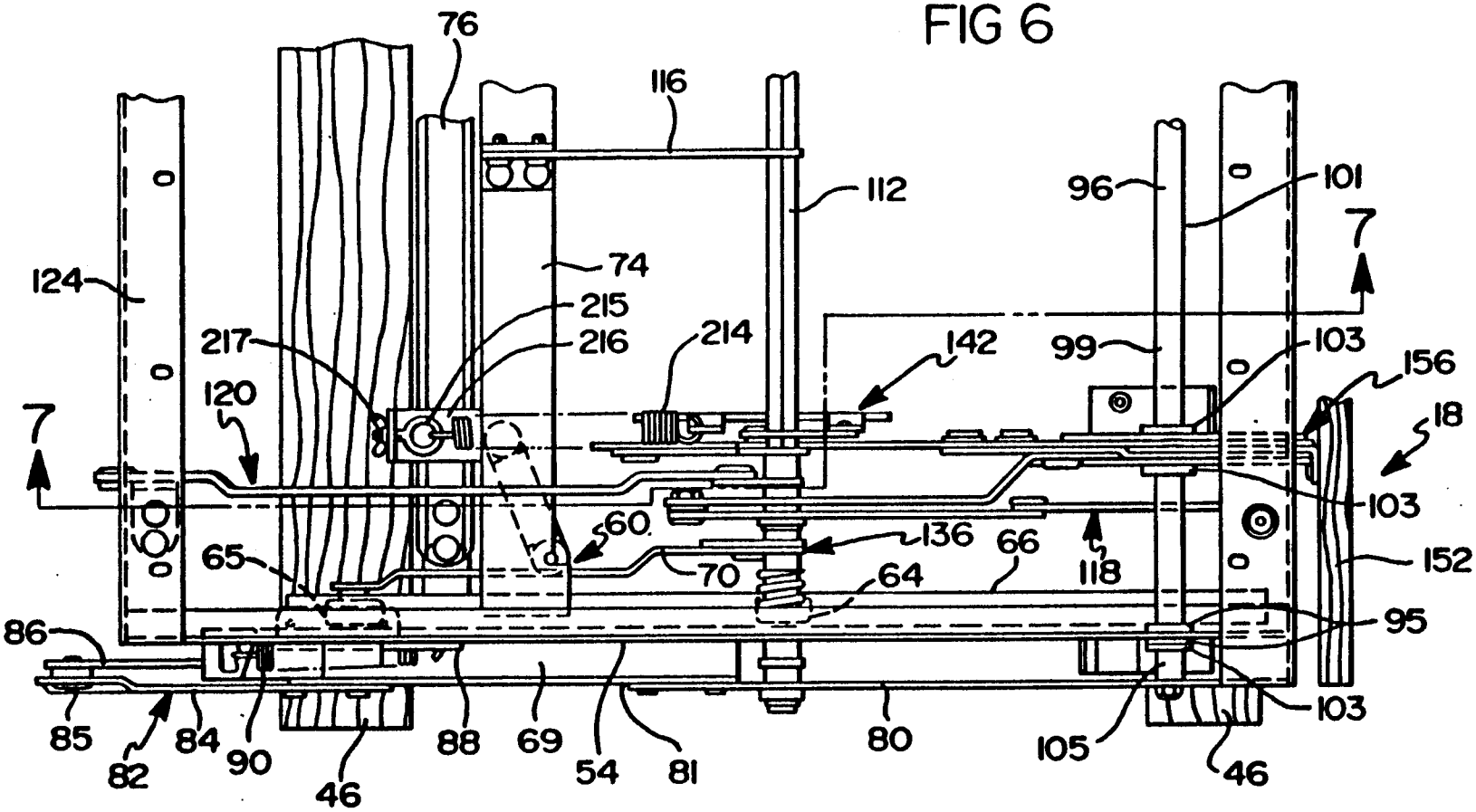
Figure 7:
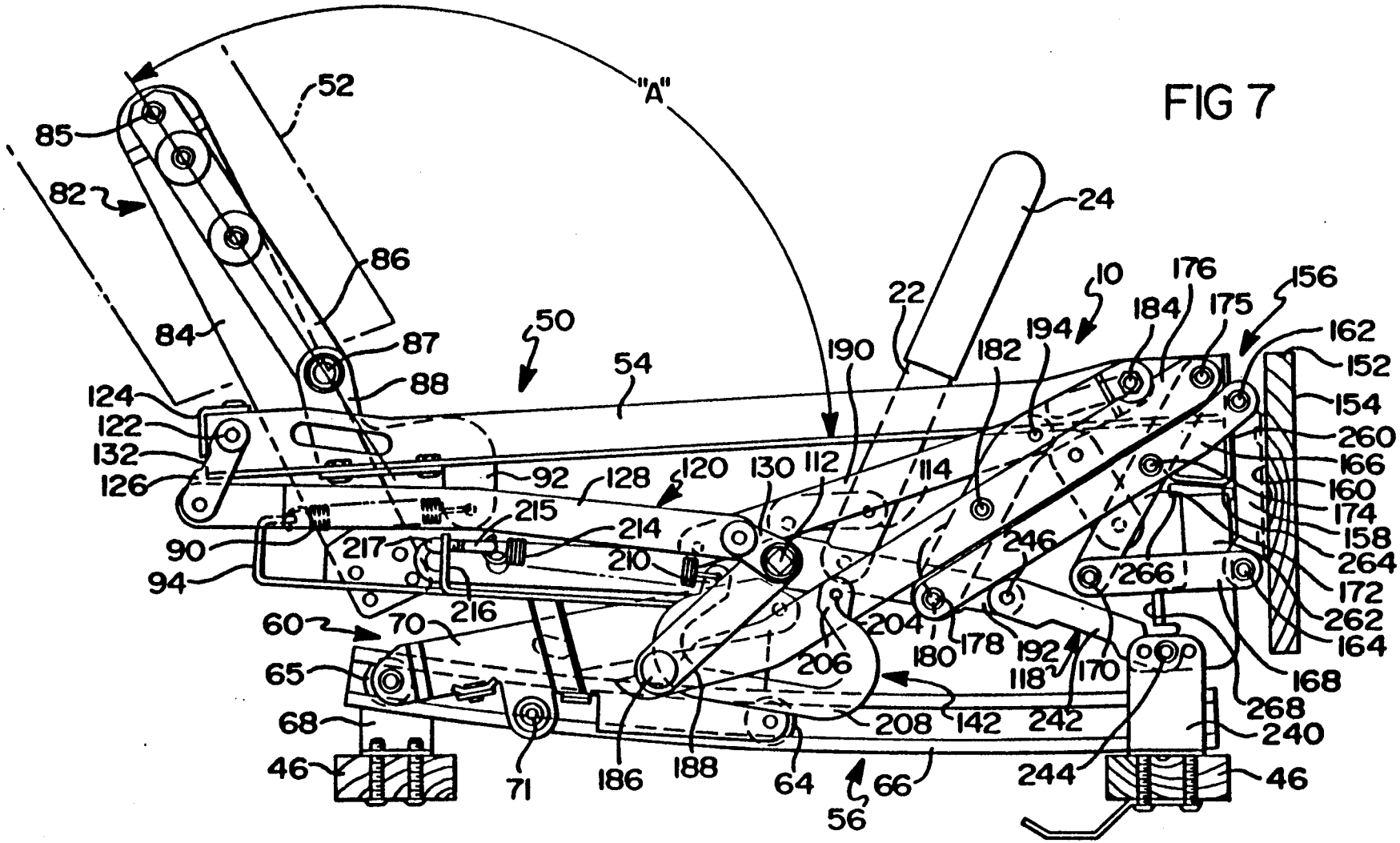
Figure 8:
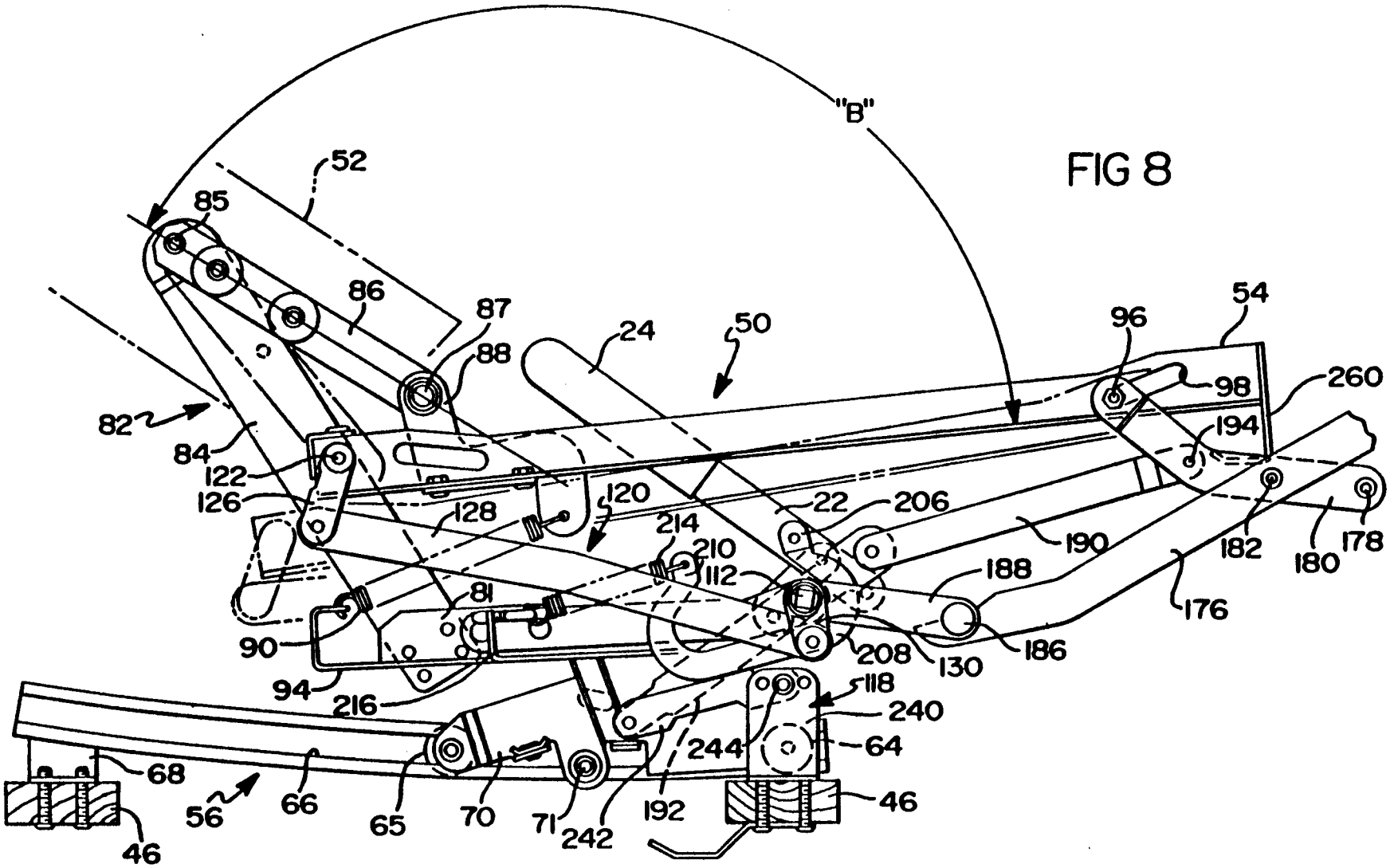
Figure 9:
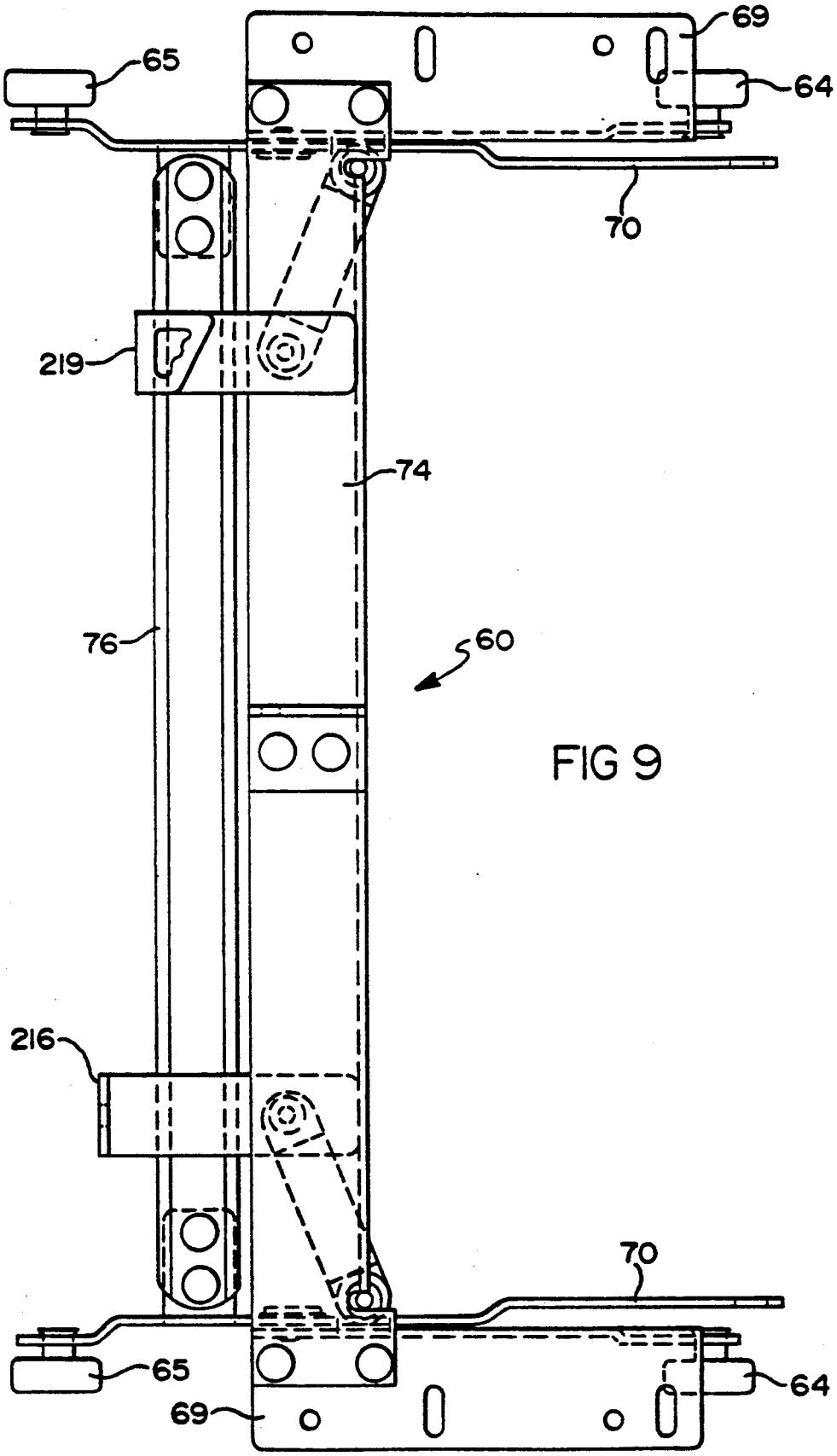
Figure 10:
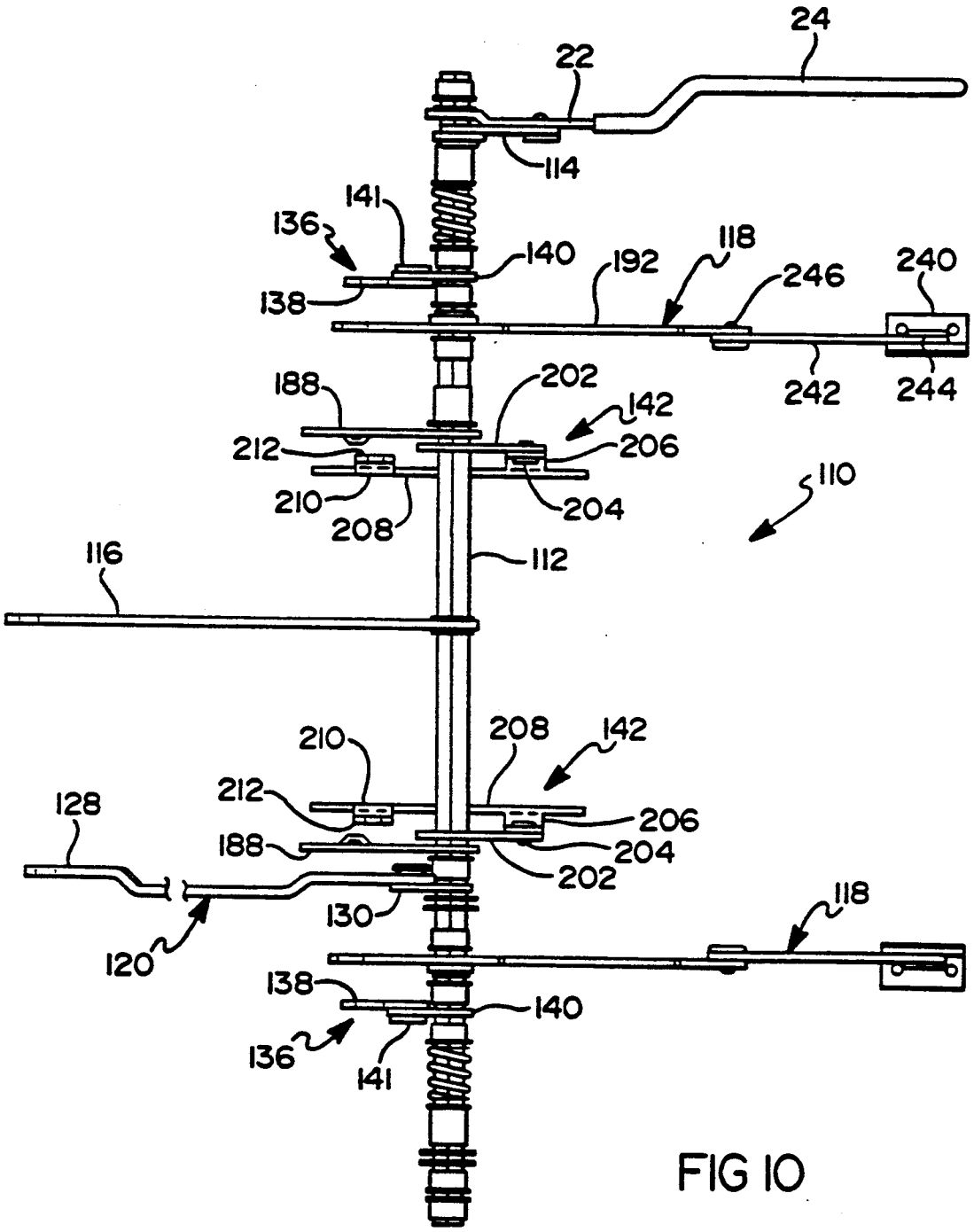

2A through 2C and which is adapted to receive the improved reclining mechanism of the present invention therein;

FIG. 4 is a perspective view with upholstery, springs, and other various parts removed, and which is partially disassembled for clarity, of the improved recliner mechanism adapted to be installed within the frame assembly of FIG. 3;

FIG. 5 is a plan view of the left half portion of the recliner mechanism of FIG. 4;

FIG. 6 is a plan view of the right half portion of the recliner mechanism of FIG. 4;

FIG. 7 is a view taken along line 7—7 of FIG. 6 illustrating the recliner mechanism in an "upright" position;

FIG. 8 is a view similar to FIG. 7 illustrating the leg rest assembly in an extended position and the seat assembly in a "tilted" (in phantom) and a fully "reclined" position;

FIG. 9 is an enlarged plan view of the wheel carriage assembly of the present invention;

FIG. 10 is a plan view of the drive rod assembly incorporated within the improved recliner mechanism of the present invention; and FIGS. 11A and 11B are side views of the tilt linkage mechanism incorporated within the improved recliner mechanism of the present invention shown in "locked" and "released" positions, respectively.

DETAILED DESCRIPTION OF THE INVENTION

In accordance with the teachings of the present invention, an improved reclining mechanism for use in single person (i.e., chairs) and multi-person (i.e., sofas and loveseats) articles of furniture is disclosed. As will be described in greater detail, the improved recliner mechanism is a "wall hugger" type or a "zero wall proximity" recliner unit. More particularly, the improved recliner mechanism is designed to travel within the confines of its stationary frame assembly for substantially flush mounting against an adjacent wall surface while permitting full reclining operation.

The recliner mechanism of the present invention is a "three-way" mechanism which can be independently "tilted", "reclined", and have its leg rest assembly operably retracted or extended. When a person sits in a loveseat or sofa equipped with the improved recliner mechanism, the leg rest assembly is extended by selectively rotating an actuator lever which is concealed in the sofa between an outer edge of the seat cushion and the inside arm. In addition, substantially concurrent "tilting" movement of the seat unit is provided upon such rotation of the actuator lever. Thereafter, independent "reclining" movement of the seat back relative to the seat is possible when the seat unit is in the "tilted" position. The recliner mechanism of the present invention is relatively compact in size to permit use of loose upholstered cushions which are modernly essential for marketing all styles of sofa or loveseat furniture.

Figures 1A, 1B, 1C, 2A, 2B, 2C:
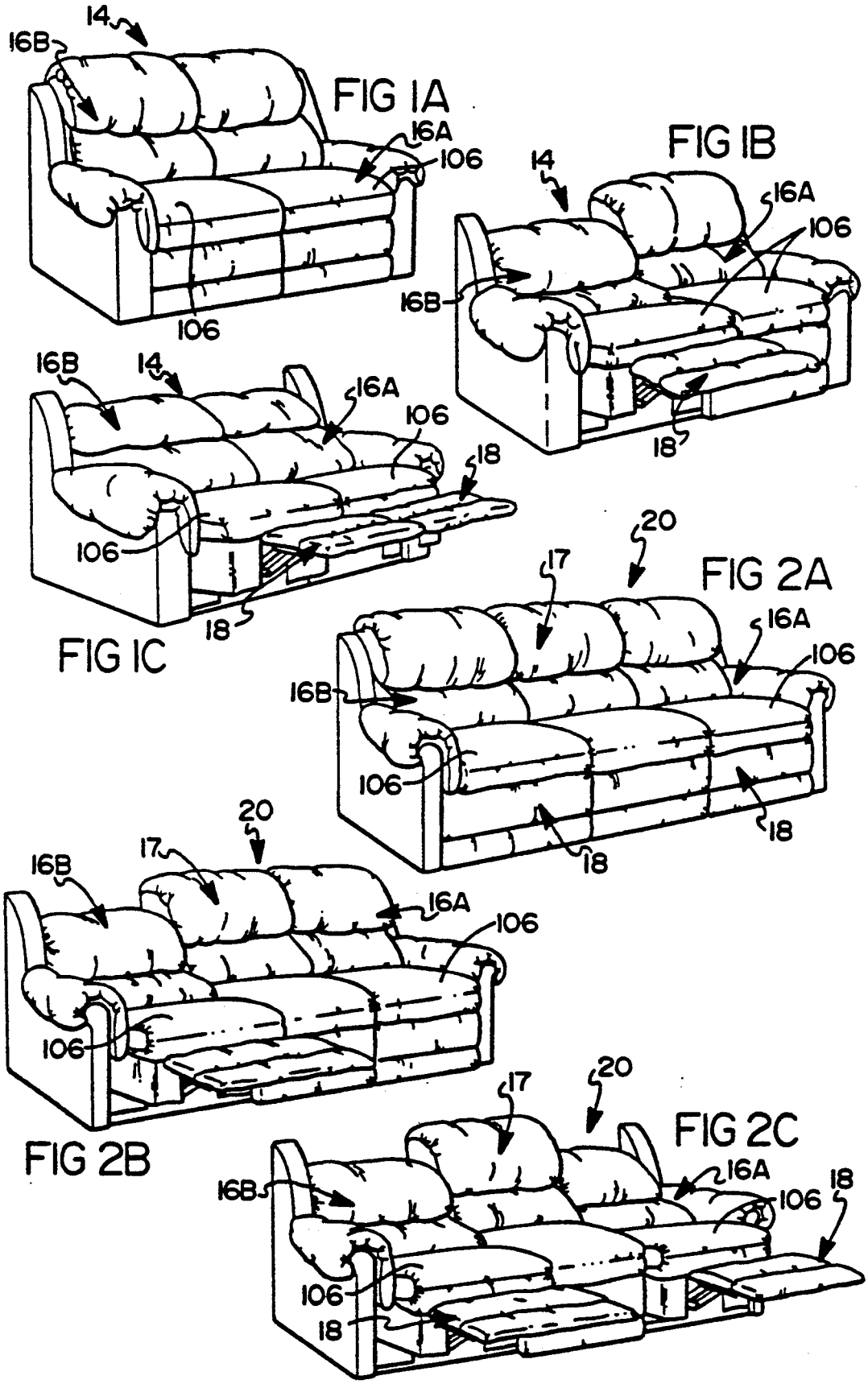
FIGS. 1A through 1C are perspective views of an exemplary upholstered "loveseat" having right and left reclining seat units embodying the present invention and which are shown in various upright and reclined positions.
FIGS. 2A through 2C are perspective views of an exemplary upholstered "sofa" having left and right recliner seat units embodying the present invention and which are shown in various upright and reclined positions.

With particular references to the drawings, the operative relationship of an improved recliner mechanism 10 of the type adapted to be supported within a frame assembly 12 will now be described in greater detail. More particularly, FIG. 1A shows an exemplary loveseat 14 having right and left upholstered an reclinable seat units 16*a* and 16*b*, respectively, both of which are in their "upright" position. FIG. 1B illustrates left seat unit 16*b* reclined with its associated leg rest assembly 18 being protracted to an elevated position. FIG. 1C depicts reclined operation of both seat units 16*a* and 16*b* and their respective leg rest assemblies 18. Similarly, an exemplary sofa 20 is shown in FIGS. 2A through 2C having right and left upholstered and reclinable seat units 16*a* and 16*b*, respectively, in various combinations of upright and reclined positions.

FIG. 4 is a perspective view of a right side recliner mechanism 10, with upholstery, padding, springs, etc. removed, which is adapted for use with right seat units 16*a* of loveseat 14 and sofa 20. It will be appreciated that the recliner mechanism to be used for left seat units 16*b* is substantially a mirror-image of that shown in FIG. 4. Moreover, the recliner mechanisms associated with seat units 16*a* and 16*b* each have a concealed actuator lever 22 with a handle portion 24 provided adjacent an arm portion of the sofa or loveseat that can be easily reached by a person seated in the seating unit for convenient actuation of recliner mechanism 10. However, it will be appreciated that other suitable manually operable release mechanism known in the art, such as a push-button cable release or an exterior mounted actuator lever, can be readily incorporated into the improved recliner mechanism of the present invention. Likewise, it is to be understood that while the preferred embodiments reflect incorporation of improved recliner mechanism 10 in sofas and loveseats, recliner mechanism 10 is likewise readily adaptable for use in other articles of furniture such as chairs, modular components, and the like.

With particular reference to FIG. 3, a stationary frame assembly 12 for sofa 20 is shown which is configured to support and retain left and right recliner mechanisms 10 therein. Frame assembly 12 defines three (3) frame sections 26, 28 and 30. Central frame section 28 is adapted to support a non-reclinable seat unit 17 thereon while outer sections 26 and 30 support seat units 16*a* and 16*b*, respectively. As will be appreciated, loveseat 14 would have a frame assembly that is substantially similar to frame assembly 12 except that center section 28 would be removed. Frame assembly 12 is preferably made of numerous wood rails that are fixedly secured together by suitable fasteners, such as dowels, staples, nails and screws, and which may be reinforced at critical joints by metal reinforcement plates or brackets and/or wood corner blocks in a known manner.

Frame assembly 12 has left and right vertical rear corner posts 32 and reinforcing rails 34 extending therebetween which are affixed to posts 32. Similarly, rear bottom rails 36 extend between and are affixed to a lower portion of posts 32. Frame sections 26 and 30 each include arm rails 38 which extend traversely to and are supported from posts 32. A diagonal brace piece 40 is used between arm rails 38 and an upper portion of vertical posts 32. Left and right lower inner side rails 42 define an inner edge for locating recliner mechanisms 10 thereon. A suitable leg assembly 44 may be affixed to the bottom of spaced bottom rails 46. Left and right recliner mechanisms constructed according to the present invention are adapted to be fixedly secured to a top surface of bottom rails 46 for full reclining operation within the confines of frame sections 26 and 30. Again, it is to be noted that the recliner mechanism mounted in left frame section 30 would be a left hand version (i.e., mirror-image) of the recliner mechanism 10 illustrated. While a specific frame assembly is described, it is to be understood that it is merely exemplary for purposes of illustration only.

With particular reference now to FIGS. 4 through 11, the various components of improved recliner mechanism 10 will be described in greater detail. In general, recliner mechanism 10 is provided to produce independent "tilting" and "reclining" movement of a seat assembly 50 within frame assembly 12 and selective operation of leg rest assemblies 18. Seat assembly 50 includes a seat back 52 and a seat frame 54 each of which is constructed in a manner that enables them to support springs, padding upholstery, etc. in order to complete a stylish and comfortable sofa or loveseat.

For purposes of clarity, the term "tilting" refers to angular movement of seat unit 16 and, in turn, seat assembly 50 relative to a stationary base assembly 56 mounted to bottom rails 46 of frame assembly 12. Recliner mechanism 10 is designed such that during "tilting" movement, a relatively constant included angle "A" between seat back 52 and seat frame 54 is maintained. Such "tilting" movement occurs substantially concurrently with protraction of leg rest assembly 18 via sufficient rotation of actuator lever 22 by the seat occupant. Likewise, return of seat unit 16 to the "upright" position occurs concurrently with return of leg rest assembly 18 to it "stowed" position. The term "reclining" refers to the relative angular movement of seat back 52 with respect to seat frame 54 for increasing the included angle to a maximum "B" therebetween. Generally, no significant "reclining" movement is possible when seating units 16 is in its normal "upright" position. However, following "tilted" movement of seat assembly 50 relative to base assembly 56, a predetermined range of additional "reclining" movement is possible for approaching a reclined position similar to a bed (i.e., a "fully" reclined position). Moreover, the present invention is designed to permit infinite adjustment of the desired reclined position within the range of reclining movement between the included angles "A" and "B".

FIG. 7 illustrates the operative relationship of seat assembly 50 and leg rest assembly 18 in their respective rear "upright" and "stowed" positions in which an occupant may enjoy conventional seating. FIG. 8 illustrates seat assembly 50 of recliner mechanism 10 in a forward fully "reclined" position and a "tilted" position (phantom lines). Likewise, leg rest assembly 18 is shown in its extended operative position. Upon rotation of actuator lever 22, seat assembly 50 is rearwardly "tilted" relative to a horizontal axis upon forward longitudinal movement on base assembly 56 to the position shown. In this "tilted" position, application of deliberate pressure by the occupant on seat back 52 permits the additional range of "reclining" movement. In this "fully" reclined position, the included angle "B" between seat back 52 and seat frame 54 is at its maximum level.

With particular reference to FIG. 4, the primary components of recliner mechanism 10 which produces the above-noted movement characteristics will now be described. Recliner mechanism 10 includes a wheeled carriage assembly 60 upon which mirror-image left and right side rail assemblies 62 are securely affixed for supporting seat assembly 50 therebetween. Carriage assembly 60 is supported for longitudinal fore and aft movement on stationary base assembly 56 for generating the "tilting" movement of seat assembly 50. More particularly, when carriage assembly 60 is released to move forward relative to base assembly 56, seat assembly 50 tilts to the "tilted" position. Likewise, rearward movement of carriage assembly 60 returns seat assembly 50 to the normal upright position.

Carriage assembly 60 is a rigid support structure having wheeled units 64 disposed for rolling movement in left and right tracks 66 of base assembly 56. Tracks 66 are aligned in parallel facing relation and are channel-shaped rectangular members which are preferably, downwardly curved from back to front to generate a gravity-assisted "down-hill" rolling movement of wheel units 64 therein. Tracks 66 are rigidly secured at opposite terminal ends via left and right angled brackets 68 to bottom rails 46 of frame assembly 12. With reference to FIG. 9, carriage assembly 60 is shown to include left and right angled brackets 69 each having a first wheel unit 64 secured to an outer forward portion thereof. Left and right pivot levers 70 are affixed to left and right angled brackets 69, respectively, for pivotable movement about pivot 71 and include a second wheel unit 65 at their rear-most end. The opposite end of pivot levers 70 is secured to its respective left and right "tilt linkages", the structure and operation of which will be described hereinafter. Extending transversely between left and right angled brackets 69 is an upper reinforcement rail 74. Similarly, transversely extending between left and right pivot levers 70 is a lower reinforcement rail 76. These reinforcement rails 74 and 76 provide structural rigidity to carriage assembly 60.

Left and right side rail assemblies 62 are affixed to carriage assembly 60 for supporting seat assembly 50 therebetween during "tilting" movement of seat assembly 50 upon forward movement of carriage assembly 60 on base assembly 56. In addition, side rail assemblies 62 pivotably interconnect seat back 52 and seat frame 54 for permitting independent "reclining" movement therebetween following "tilted" movement. Each side rail assembly 62 includes a seat plate 80 fixedly secured to a side plate bracket 81 which is, in turn, secured to its respective angled bracket 69 of carriage assembly 60. Left and right seat swing assemblies 82 are provided for pivotally coupling seat back 52 to seat frame 54 for "reclining" movement therebetween.

Seat swing assemblies 82 each include a generally rearwardly upstanding back member 84 having a lower end secured to a rearward end of its respective side plate bracket 81. The upper ends of back members 84 are pivotally coupled at pivot 85 to a first end of swing members 86 upon which seat back 52 is mounted in a conventional manner. The opposite end of left and right swing members 86 are pivotally connected at pivots 87 to left and right seat brackets 88 which are, in turn, securely mounted to left and right frame rails of seat frame 54. Left and right extension springs 90 are attached between forward extensions 92 on seat brackets 88 which extend below seat frame 54 and rearwardly extending extension brackets 94 secured to angled carriage brackets 69. As such, seat assembly 50 is normally biased in a direction to maintain the normal included angle "A" between seat frame 54 and seat back 52 regardless of its "upright" or "tilted" relation to base assembly 56. Extension brackets 94 are provided with a plurality of stepped surfaces to which springs 90 can be selectively attached to permit adjustment of the spring biasing force acting on seat assembly 50.

A front support shaft 96 extends through lost-motion slots 98 formed in the left and right frame rails of seat frame 54 and is connected at its opposite ends to an upper end of left and right seat plates 80. The length of slots 98 define the range of forward movement of seat frame 54 relative to side rail assemblies 62 upon the seat occupant applying a force to "recline" seat back 52 (see FIGS. 7 and 8). In addition, friction means are provided for generating slight frictional drag upon movement of support shaft 96 within slots 98. In particular, nylon washers 95 coaxially supported on shaft 96 on opposite sides of slots 98, are biased to generate sufficient frictional drag to coact with extension springs 90 for permitting infinite reclining adjustment of seat assembly 50 between nonreclined included angle "A" and fully reclined included angle "B". Such interaction between springs 90 and the friction means also produces stable and smooth reclining movement which is not overly-sensitive to small amounts of movement by the seat occupant.

With reference to FIGS. 5 and 6, nylon washers 95 are shown biased by the interaction of several components. In particular, a spring 97 is provided which concentrically surrounds support shaft 96 between right seat plate 80 and a nylon washer 95 adjacent an outer surface of slot 98 (FIG. 5). Right and left short tubular spacer sleeves 99 and a longer central spacer sleeve 101 are coaxially supported on support shaft 96 and are provided for positively locating and separating portions of pantograph leg rest linkages 156, to be described hereinafter, thereon. Wave washers 103 provide a slight sideloading on spacer sleeves 99 and 101 and washers 95 to produce a rigid support shaft 96.

Swing assemblies 82, extension springs 90 and the friction means provided on support shaft 96 coact to substantially maintain the normal included angle "A" (FIG. 7 and FIG. 8 in phantom) between seat back 52 and seat frame 54 upon "tilting" of seat assembly 50 when carriage assembly 60 is released to roll downwardly and forwardly in tracks 66 of base assembly 56. However, to permit independent "reclining" movement for increasing the included angle to a maximum of "B", swing members 86 each pivot about both pivots 85 and 87 to cause substantially synchronous rearward pivotal movement of seat back 52 and forward movement of seat frame 54.

As is apparent, recliner mechanism 10 is confined below seat frame 54 with tracks 66 being affixed directly to wooden bottom rails 46 of frame assembly 12. In this manner, an overall reduction in the height of recliner 10 permits use of loose cushions 106 (FIGS. 1 and 2) removably installed on top of seat frame 54. In addition, recliner mechanism 10 is designed to cause less upward angular movement of seat frame 54 than conventional recliners upon forward motion thereof during "tilting" and "reclining" which significantly reduces the effort required for the seat occupant to return seat assembly 50 to the upright position and return leg rest assembly 18 to the stored position.

As previously noted, the preferred embodiment includes an actuation lever 22, which is hidden from view in the space between the outside edge of a cushion 106 and the upholstered inside face of sofa 20, and which must only be rearwardly pivoted a relatively small amount (approximately between 30–45° in the preferred embodiment) by its forwardly extending handle 24 when the seat occupant wants to release carriage assembly 60 for "tilting" seat assembly 50 and raising leg rest assembly 18. More specifically, pulling back on handle lever 24 produces corresponding angular movement (counterclockwise in the drawings) of a square cross-section transverse drive rod assembly 110 which is rotatably supported by suitable means at its opposite ends to left and right seat plates 80 of left and right side rail assemblies 62. The axis of rotation of drive rod 112 is generally parallel to the axis of rotation of front and rear wheel units 64 and 65, respectively.

According to the preferred embodiment, carriage assembly 60, leg rest assembly 18, and drive rod assembly 110 are operatively interconnected so that when one moves, all move, (i.e., rotation of drive rod 112 is accompanied by movement of carriage assembly 60 on base assembly 56 and movement of leg rest assembly 18). Once the occupant has pivoted handle 24 through an angle of about 30°–45° which, in turn, correspondingly rotates drive rod 112, the weight of the seat occupant in cooperation with the force amplification and mechanical advantage of drive rod assembly 110 act to release (i.e., unlocks) carriage assembly 60 for forward movement on base assembly 56 for smoothly and continuously driving the various linkages until seat assembly 50 is in the forward "tilted" position with leg rest 18 extended.

Angular movement of drive rod 112 about its axis results in movement of various linkage mechanisms for causing actuation of leg rest assembly 18 and "tilting" movement of seat assembly 50 by releasing carriage assembly 60 to roll in tracks 66. As will be appreciated, the various linkages are designed to only require a limited range of angular movement of drive rod 112 via limited rotation of actuation lever 22 for putting recliner mechanism 10 into operation. In addition, the weight of the seat occupant and the center of gravity of seat assembly 60 defined by the orientation of wheel units 64 and 65 disposed within tracks 66 combine to generate a forwardly directed force on carriage assembly 60 which augments the limited occupant input required for improved operation of recliner 10. In addition, over-center toggle assemblies for leg rest assembly 18 and for carriage assembly 60 are designed to selectively lock and drive seat assembly 50 and leg rest assembly 18 between their respective "upright" and "stowed" positions and their "tilted" and "extended" positions.

Actuator lever 22 and its handle 24 are pivotally supported for angular movement to one of seat plates 80 and are located slightly forward of drive rod 112. A transfer linkage 114 connects actuator lever 22 to drive rod 112 for transferring the angular movement thereto A stabilizer rail 116 is secured between a central portion of drive rod 112 and upper reinforcement rail 74 of carriage assembly 60. Stabilizer rail 116 permits rotation of drive rod 112 while providing structural rigidity with carriage assembly 60.

With particular reference now to FIGS. 7 and 8, means are provided for releasably locking drive assembly 110 for retaining carriage assembly 60 in its rear-upright position. More particularly, on opposite sides of stabilizer rail 116 there are provided left and right base bracket linkage assemblies 118 which are interconnected between bottom rails 46 of frame assembly 12 and pantograph linkages 156 of leg rest assembly 18 for acting as an over-center mechanism for releasably "locking" carriage assembly 60 in its rear-upright position as shown in FIG. 7. Bracket linkage assembly 118 includes a bracket 240 affixed to bottom rail 46 of frame assembly 12 and a base link 242 pivotally supported thereto about pivot 244. The opposite end of base link 242 is pivotably coupled to swing link 192 about pivot point 246. A rearward portion of swing link 192 is journally supported on drive rod 112 for free angular movement relative thereto. The opposite rear end of swing link 192 is pivotally interconnected to a first end of power link 190. In the upright-stowed position of FIG. 7, a line of action extending through drive rod 112 and pivot 244 positions pivot point 246 in an over-center orientation for inhibiting forward non-actuated movement of carriage assembly 60 and leg rest assembly 18. Upon initial angular movement of handle 24 by the seat occupant, drive rod 112 rotates to initiate protraction of pantograph linkages 156 of leg rest assembly 18 outwardly toward their extended operative position. Such actuation of pantograph linkages 156 causes power link 190 to pivotably move swing link 192 until pivot point 246 is positioned below the line of action (i.e., over-center) to release carriage assembly 60 for forward rolling movement in tracks 66 and to release leg rest assembly 18 for movement to its fully extended position. A bent-over tab 248 formed on bracket 240 is provided to engage an edge surface of base link 242 to limit the over-center location of pivot point 246 relative to the line of action as shown in FIG. 7.

A locking mechanism 120 is provided which inhibits "reclining" movement of seat assembly 50 in the "upright" position and which coacts with slots 98 for limiting the range of "reclining" movement of seat assembly 50 once it is in the "tilted" position. More specifically, locking mechanism 120 includes a lock pivot 122 secured to rear frame rail 124 of seat frame 54, a lock lever 126 pivotally supported at one end to lock pivot 122, an elongated lock arm 128 pivotally connected to the opposite end of lock lever 126 and which extends generally parallel to side rail assemblies 62. The forward end of lock arm 128 is pivotally connected to a lock link 130 which is secured for angular movement with drive rod 112. A notch 132 in the rear edge of lock lever 126 is adapted to contact rear frame rail 124 for limiting the "reclining" movement of seat back 52 when recliner mechanism 10 is in its "tilted" positions.

With particular reference to FIGS. 11A and 11B, drive rod assembly 110 is shown to include left and right "tilt" linkages 136 which are generally coactive with bracket linkage assemblies 118 for selectively inhibiting (i.e., locking) and permitting (i.e., releasing) forward movement of carriage assembly 60 on base assembly 56. In general, tilt linkages 136 interconnect the forward end of pivot levers 70 of carriage assembly 60 to drive rod assembly 110. More particularly, the forwardmost end of pivot levers 70 extend below and are generally aligned with the axis of drive rod 112 and are pivotally connected to a lower end of a C-shaped toggle link 138. The other end of C-shaped toggle link 138 is pivotably connected to a connector link 140 at pivot 142 and which, in turn, is secured on drive rod 112 for angular movement therewith. When recliner mechanism 10 is in the upright position (FIG. 11A), tilt linkage assemblies 136 are inhibited against forward movement of carriage assembly 60 until actuator lever 22 and, in turn, drive rod 112 are sufficiently rotated (approximately 30°–45°) for causing bracket linkage assemblies 118 to move to the over-center position. Rotation of drive rod 112 causes corresponding rotation of connector link 140 until pivot 142 is aligned with or slightly below the rotational axis of drive rod 112 (FIG. 11B). At this point, bracket linkage assemblies 118 have gone over-center to release carriage assembly 60 such that loading acting on carriage assembly 60 (i.e., weight of occupant) and the mechanical advantage of tilt linkages 136 act to forwardly drive C-shaped toggle 138 around and below drive rod 112 so as to permit pivot levers 70 to pivot about pivot points 71 such that carriage assembly 60 is "tilted" upon forward rolling movement in tracks 66. In addition, tilt linkages 136 provide significant force amplification so that the force required for the occupant to pivot handle 24 is not excessive. It will be appreciated that left and right spring-assist toggle mechanisms 142 associated with operation of leg rest assembly 18 which will be hereinafter described, work coactively with bracket linkage assemblies 118 and tilt linkages 136 to smoothly and continuously drive recliner mechanism 10 for extending leg rest assembly 18 and for "tilting" seat assembly 50 in a substantially concurrent manner.

Leg rest linkage assembly 18, pantograph linkages 156, and left and right toggle mechanisms 142 are seen best in FIGS. 4, 7, and 8. These devices are similar to, but not identical with, corresponding mechanisms shown and described in the present assignee's U.S. Pat. No. 4,367,895, issued Jan. 11, 1983, entitled "Reclinable Chair" as well as its U.S. Pat. No. 3,099,487, issued Jul. 30, 1963, entitled "Leg Rest Fixture and Supplemental Holding Mechanism".

With particular reference to FIG. 7, leg rest assembly 18 is shown to include a frame board 152 having an upper surface 154 that is padded and upholstered so that in the finished sofa it will be as shown in FIGS. 1 and 2. Board 152 is supported on and moved by identical left and right hand pantograph linkages 156. Board 152 has an angled bracket 158 secured to its bottom face 160 for each pantograph 156 whereby board 152 is pivotally connected at a rear pivot 162 and a front pivot 164 to board links 166 and 168, respectively, of pantographs 156. The other end of front board link 168 is pivoted at 170 to an end of connector link 172 which is centrally pivoted at 174 to a portion of board link 166. The other end of connector link 172 is pivoted at 175 to the top of a long support link 176. The other end of rear board link 166 is pivoted at 178 to one end of a curved link 180 which is pivoted at a central pivot 182 to a central portion of long support link 176. The other end of curved link 180 is pivoted at 184 to front support shaft 96. Pivot 184 is a point of support on carriage assembly 60 for pantographs 156.

Another point of support is pivot 186 at the curved bottom end of long support link 176 which connects support link 176 to one end of drive link 188, the other end of which has a square aligned hole through which square drive rod 112 extends so that drive link 188 is generally driven by angular movement of drive rod 112. Thus, rotation of drive rod 112 turns drive link 188 which acts through pivot 186 to move long support link 176. Such movement of support link 176 causes link 180 to swing about fixed pivot 184 by virtue of pivot connection 182 that link 180 has with long support link 176. The action of link 180 swinging about fixed pivot 184 moves rear board link 166 outwardly and upwardly while pivot 175 at the top end of long support link 176 causes link 172 to swing about pivot 174 and thus front board link 168 is also moved outwardly and upwardly. This extensible action takes place simultaneously with both the left hand and right hand pantographic linkage mechanisms 156 when there is sufficient angular movement of drive rod 112 to unlock toggle mechanism 142. The effect is to move frame board 152 between its stowed vertical position (FIGS. 1B, 2B and 7) and its elevated, relatively horizontal position (FIGS. 1C, 2C and 8).

Left and right power links 190 are shown to extend over drive rod 112 and are pivotally supported at their rearward end on a portion of swing links 192 mounted on drive rod 112 and at their top ends at pivots 194 located on a central portion of curved links 180. Upon swinging movement of curved links 180 in the manner previously described, power links 190 act to assist in driving pantograph linkages 156 to their extended operative position. As mentioned, power link 192 interconnects pantograph linkages 156 to bracket linkage assemblies 118.

Left and right hand spring-assist toggle assemblies 142 are provided which, as pointed out in U.S. Pat. Nos. 3,099,487 and 4,367,895, work with leg rest assembly 18. Toggle assemblies 142 provide means for holding leg rest assembly 18 tightly in a fully retracted (i.e., stowed) position against the front of the sofa frame and also provides means for supplying a spring force for driving leg rest assembly 18 to its extended position. Toggle assemblies 142 each include a toggle lever 202 with a square hole which is mounted by means of the square hole on square drive rod 112 for selective rotation therewith. Toggle lever 202 is pivotally connected at 204 to front leg 206 of a C-shaped toggle link 208 that curves around, below and to the rear of drive rod 112 where its rear leg 210 has an opening 212 in which one end of a helical coil spring 214 is hooked. The opposite end of spring 214 is hooked to an eye screw 215 threadably secured to spring bracket 216 which, in turn, is secured to upper stabilizer rail 74. As shown in FIG. 6, a wing nut 217 is provided for adjusting the tension in spring 214. For example, the tension in spring 214 can be adjustable relieved for a lighter weight occupant or it can be increased for a heavier seat occupant. Such adjustment means provide an extra comfort and convenience feature to recliner mechanism 10. The opposite spring 214 is shown in FIG. 5 to be secured to a second bracket 219 which has stepped surface means for stepwise spring biasing adjustment similar to bracket 94.

Operation of toggle assemblies 142 will now be described in greater detail. The location of pivot 204 below drive rod 112 and the line of action of springs 214 are such in the retracted position of leg rest assembly 18 that the spring force holds or "retains" leg rest assembly 18 retracted. As leg rest 18 is initially slightly extended upon rotation of actuator lever 22 and, in turn, drive rod 112, pivot 204 moves up and over center of the drive rod axis. Once pivot 204 is over center, tension loading on springs 214 assist in drivingly rotating drive rod 112 for elevating leg rest assembly 18 as rear leg 210 of link 208 is pulled toward reinforcement rail 74. In addition, springs 214 assist the occupant in pivoting handle 24 through the required actuation angle. Once drive rod 112 has been sufficiently pivoted through the limited actuation angle to release carriage assembly 60 (via bracket linkage assemblies 118) and leg rest assembly 18 (via toggle mechanisms 142), the weight of the seat occupant and the biasing of springs 214 rotate handle 24 to the fully pivoted and concealed position shown in FIG. 8.

Downward pressure applied manually to frame board 152 by the seat occupant serves as means to move leg rest assembly 18 back to the "stowed" position and carriage assembly 60 rearwardly for tilting seat assembly 50 to the "upright" position. Such pressure has the benefit of a long moment arm and produces a downward rearward movement of long support links 176 which act through their pivots 186 to rotate drive links 188 in a rearward direction. This causes corresponding angular movement of drive rod 112 (i.e., clockwise in the drawings). When pivot 204 is rotated over center upon continued clockwise movement of drive rod 112, C-shaped toggle links 208 and springs 214 act as locking means to solidly hold leg rest assembly 18 in its stowed position. Likewise, this same clockwise rotation of drive rod 112 causes swing links 192 and base links 242 of bracket linkage assemblies 118 to be rotated overcenter for retaining carriage assembly 60 against forward movement which, in turn, assist in retaining seat unit 16 in its "upright" position. It will be appreciated that the various linkages are designed to work substantially simultaneously and in a cumulative manner. The relatively low input force to be exerted on frame board 152 by the occupant permits smooth retraction of recliner mechanism 10 to the conventional seating arrangement position of FIGS. 4 and 7. Likewise, toggle mechanisms 142 and tilt linkages 136 are adapted to return to their original position (FIG. 7) for assisting in locking carriage assembly 60 and leg rest assembly 18 in their respective "upright" and "stowed" positions upon rearward movement of leg rest assembly 18 to a position in close proximity to the normal "stowed" position. As will be appreciated, this "locking" position is directly related to the amount of pivotable movement of actuator lever 22 required to actuate recliner mechanism 10.

Another feature of the present invention incorporated into recliner mechanism 10 provides rigidity and support to the forward end of seat assembly 50 when retained in the "upright" position and which controls forward movement of carriage assembly 60 for supporting leg rest assembly 18 in its fully extended position. In particular, seat frame brackets 260 are affixed to front corner surfaces of seat frame 54 and are adapted to matingly contact brackets 262 supported from brackets 240 when seat assembly 50 is in its rear-upright position and a load is applied thereto. In particular, frame brackets 260 have a surface, such as a nylon insert 264, which is adapted to engage a facing insert 266 supported on bracket 262. Therefore, weight transferred downwardly onto the front of seat frame 54 is supported to inhibit "sagging" of seat assembly 50. Brackets 262 are also formed to include a vertical stop surface 268 adapted to engage a forward edge surface of brackets 69 of carriage assembly 60 when carriage assembly 60 is in its forwardmost position relative to tracks 66. This engagement provides addition support to leg rest assembly 18 through its linkages to inhibit "sagging" thereof in the extended operative position.

Thus, the invention provides a sofa construction that has a seat frame 54 and seat back 52 that move between an "upright" position (FIG. 7), a "tilted" position (FIG. 8 in phantom) and a "reclined" position (FIG. 8). Manual force, leveraged through leg rest pantographic linkages 156, is used to overcome gravity and the spring force provided within recliner mechanism 10 for smoothly and easily returning seat assembly 50 from the "tilted" to the "upright" position and leg rest assembly 18 from its extended to its stowed position.

The foregoing discussion discloses and describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A seating unit for use in an article of furniture of the type having a stationary frame section within which said seating unit is secured for longitudinal and angular movement therein, said seating unit comprising:

track means secured to a base within said frame section;

a seat assembly having a seat member, a seat back, and swing link means for pivotally interconnecting said seat back and seat member to permit reclining movement of said seat assembly between a non-reclined first position and a reclined second position in response to pressure applied by a seat occupant to said seat back;

carriage means supporting said seat assembly for translational and tilting movement on said track means between a rear-upright position and a forward-tilted position;

a leg rest assembly supported for movement with said carriage means between a retracted position when said carriage means is in said rear-upright position and an extended operative position when said carriage means is in said forward-tilted position;

drive means for operatively connecting said carriage means and said leg rest assembly, said drive means being movable between a locked position wherein said carriage means is releasably retained in said rear-upright position and a released position for permitting said carriage means to move to said forward-tilted position;

first over-center linkage means for selectively moving said drive means between said locked and released positions, said first over-center linkage means being movable between a first position for releasably locking said drive means in said locked position and a second position for moving said drive means to said released position;

tilt linkage means operatively coupling said carriage means to said drive means for causing tilting movement of said seat assembly toward said forward-tilted position when said drive means is in said released position, said tilt linkage means being operable for assisting said first over-center linkage means in releasably locking said carriage means in said rear-upright position when said drive means is in said locked position;

second over-center linkage means operatively coupling said leg rest assembly to said drive means for biasingly retaining said leg rest assembly in said retracted position when said drive means is in said locked position and for biasingly driving said leg rest assembly toward said extended operative position when said drive means is in said released position;

locking means operably interconnecting said seat assembly to said drive means for inhibiting reclining movement of said seat assembly from said non-reclined first position toward said reclined second position when said drive means is in said locked position, said locking means being operable to permit reclining movement of said seat assembly when said drive means is in said released position whereby said seat back is substantially confined within said frame section during tilting and reclining movement of said seat assembly; and manually operated actuation means for moving said first over-center linkage means from said first position to said second position.

2. The seating unit of claim 1 wherein said first over-center linkage means comprises a three bar over-center locking mechanism.

3. The seating unit of claim 1 wherein said track means are downwardly angled from back to front whereby the weight of said carriage means and said seat occupant generate a forwardly directed force acting to move said carriage means in a direction toward said forward-tilted position.

4. The seating unit of claim 1 further comprising biasing means for biasing said seat assembly toward said non-reclined first position;

5. The seating unit of claim 4 wherein said carriage means is a rigid carriage assembly having a pair of wheel means disposed for rolling movement within said track means and having pivot link means upon which one of said pair of wheels is mounted, said pivot link means interconnecting said carriage assembly to said tilt linkage means and being operable to tilt a portion of said carriage assembly relative to said wheels when said tilt linkage means is moved in response to movement of said drive means.

6. The seating unit of claim 5 wherein said drive means includes a transverse rotatable drive rod and said manually operated actuation means being operatively connected to said drive rod for rotating said drive rod through a predetermined and limited angle to move said first over-center linkage means to said second position for permitting actuation of said tilt linkage means and said second over-center linkage means.

7. The seating unit of claim 6 wherein said tilt linkage means is a toggle linkage mechanism interconnected between said drive rod and said pivot link means of said carriage assembly whereby rotation of said drive rod moves said toggle linkage mechanism and movement of said toggle linkage mechanism rotates said drive rod.

8. The seating unit of claim 7 wherein said toggle linkage mechanism includes a connector link mounted for rotation on said drive rod and a toggle link pivotally connected about a first pivot at one end to said connector link, said toggle link being pivotally connected about a second pivot at its opposite end to said pivot link means of said carriage assembly, said toggle link age mechanism being operative to assist said first over-center linkage means in locking said carriage assembly in said rear-upright position when said first pivot is above the line of center defined by said drive rod, and said toggle linkage mechanism being operative to tilt said seat assembly on said carriage assembly upon movement thereof toward said forward-tilted position when said first pivot is below said center of said drive rod.

9. The seating unit of claim 7 wherein movement of said carriage assembly relative to said track means toward said forward-tilted position acts to rotate said drive rod and wherein said leg rest assembly is operatively connected to said drive rod such that a rearwardly directed force applied to said leg rest assembly acts to move said leg rest assembly to said retracted position which concurrently rotates said drive rod for moving said carriage assembly to its rear-upright position until said first linkage means locks said drive rod for retaining said carriage assembly in said rear-upright position.

10. The seating unit of claim 7 further including rail means provided on opposite adjacent sides of said seat assembly for interconnecting said seat assembly to said carriage assembly and for supporting said seat assembly for reclining movement relative thereto, said rail means supporting said transverse drive rod and said manually operated actuation means, and wherein said manually operated actuating means comprises a handle pivoted on one of said rail means and having transfer linkage connecting said handle to said drive rod.

11. The seating unit of claim 10 including stop means for inhibiting additional forward movement of said carriage assembly when it reaches said forward-tilted position.

12. The seating unit of claim 7 wherein said leg rest assembly includes pantograph linkage means operatively connected to said drive rod such that rotation of said drive rod moves said leg rest assembly and movement of said leg rest assembly rotates said drive rod, and wherein said second over-center linkage means includes a second toggle linkage mechanism operatively connected to said drive rod, said second toggle linkage mechanism adapted for biasingly retaining said leg rest assembly in said retracted position when said carriage assembly is locked in said rear-upright position, and said second toggle linkage mechanism is adapted for biasingly forwardly driving said leg rest assembly toward said elevated position upon release of said carriage assembly.

13. The seating unit of claim 12 wherein said second toggle linkage mechanism is an over-center device including a toggle lever secured to said drive rod for rotation therewith, said toggle lever pivoted to a first leg of a C-shaped toggle link which curves around and below said drive rod and which has a second leg, and spring means secured between a portion of said carriage assembly rearward on said toggle link and said second leg thereof, whereby said spring means acts on said drive rod to bias said leg rest assembly toward its retracted position when said pivot connection between said toggle lever and said first leg of said toggle link is located below said drive rod and wherein said spring means forwardly drives leg rest assembly to its operative extended position when said pivot connection between said toggle lever and said first leg of said toggle link is rotated above said drive rod via rotation of said manually operated actuation means.

14. The seating unit of claim 13 wherein said rail means supporting a transversely extending support shaft extending through slots formed in side frame members of said seat member, said support shaft supporting said carriage assembly and said leg rest assembly when said seat assembly is moved to its forward-tilted and reclined positions, said slots adapted to coact with said swing link means for limiting the translational movement of said seat member upon independent reclining movement thereof.

15. A reclining seating unit for use in an article of furniture having an outer frame comprising:

a seat assembly having a seat and a seat back;

support means for supporting said seat assembly within said outer frame, said support means including translational means for moving said seat assembly relative to said outer frame between a rear-upright position and a forward-tilted position, said support means including swing means providing independent reclining movement of said seat assembly relative to said support means between a non-reclined first position and a reclined second position in response to pressure applied by a seat occupant to said seat back when said seat assembly is in said forward-tilted position;

said support means being constructed and arrange so that the weight of said seat assembly and said seat occupant provide a forwardly-directed force acting to move said seat assembly from said rear-upright position toward said forward-tilted position;

drive means operably associated with said translational means for movement between a locked position wherein said seat assembly is releasably retained in said rear-upright position and a released position permitting said seat assembly to move toward said forward-tilted position;

over-center linkage means for selectively locking said drive means so as to releasably lock said seat assembly in said rear-upright position, said over-center linkage means being operable for selectively unlocking said drive means and thereby releasing said seat assembly for movement toward said forward-tilted position;

tilt linkage means operatively coupling said translational means to said drive means for causing tilting movement of said seat assembly toward said forward-tilted position when said drive means is in said released position, said tilt linkage means being operable for assisting said over-center linkage means in releasably locking said seat assembly in said rear-upright position when said drive means is in said locked position; and manually operated actuation means for selectively actuating said over-center linkage means to unlock said drive means to allow said seat assembly to move from said rear-upright position to said forward-tilted position whereby said seat assembly is adapted for tiling sand reclining movement substantially completely within said outer frame.

16. The reclining seating unit of claim 15 further comprising biasing means for biasing said seat assembly toward said first non-reclined position.

17. The reclining seating unit of claim 15 further including a leg rest assembly having pantograph linkage means operatively connected to and driven by said support means such that said leg rest assembly is urgingly retained in a retracted condition when said seat assembly is in said rear-upright position and said leg rest assembly is urgingly retained in an extended operative condition when said seat assembly is in said forward-tilted position.

18. The reclining seating unit of claim 17 wherein said translational means of said support means includes track means secured to a base portion of said outer frame, and carriage means supporting said seat assembly for translational and tilting movement on said track means between said rear-upright and said forward-tilted position.

19. The reclining seating unit of claim 18 further comprising biasing means for biasing said seat assembly toward said non-reclined first position, and locking means for inhibiting movement of said seat assembly to said reclined second position when said carriage means is retained in said rear-upright position such that said seat back is substantially confined for rearward reclining movement entirely within the confines of said outer frame to define a zero wall proximity reclining and tilting seat assembly.

20. The reclining seating unit of claim 19 wherein said drive means operatively interconnects said carriage means and said leg rest assembly, said drive means being movable between said locked position for retaining said carriage means in said rear-upright position, and said released position for concurrently releasing said carriage means for movement toward said extended operative condition, and wherein said over-center linkage means is associated with said drive means for releasably locking said drive means in said locked position until said manually operated actuation means is actuated to move said over-center linkage means and said drive means to said released position.

21. The reclining seating unit of claim 20 further including second over-center linkage means operatively coupling said leg rest assembly to said drive means for biasingly retaining said leg rest assembly in said retracted position when said drive means is in said locked position and for biasingly driving said leg rest assembly toward said extended operative position when said drive means is in said released position.

22. The reclining seating unit of claim 21 wherein said tilt linkage means includes a first goggle linkage mechanism and said drive means includes a transverse rotatable drive rod supported by said seat assembly such that said first toggle linkage mechanism is connected between said drive rod and said carriage means such that rotation of said drive rod moves said first toggle linkage mechanism and movement of said first toggle linkage mechanism rotated said drive rod, said manually actuated means being operatively connected to said drive rod to permit said seat occupant to rotate said drive rod through a predetermined and limited angle for moving said first over-center linkage means to release said drive means.

23. The reclining seating unit of claim 22 wherein said second over-center linkage means includes a second toggle linkage mechanism which operatively couples said leg rest assembly and said drive means for biasingly retaining said leg rest assembly in said retracted condition when said drive means i in said locked position and for biasingly driving said leg rest assembly toward said extended position when said drive means is moved to said released position.

24. The reclining seating unit of claim 23 wherein said second toggle linkage mechanism is an over-center device including toggle lever secured to said drive rod for rotation therewith, said toggle lever pivoted to a first leg of a C-shaped toggle link which curves around and below said drive rod and which has a second leg, and spring means secured between a portion of said carriage assembly rearward of said toggle link and said second leg thereof, whereby said spring means acts on said drive rod to bias said leg rest assembly toward its retracted position when said pivot connection between said toggle lever and said first front leg of said toggle link is located below said drive rod and wherein said spring means forwardly drives leg rest assembly to its operative extended position when said pivot connection between said toggle lever and said first leg of said toggle link is rotated above said drive rod via rotation of said manually operated actuation means.

25. The reclining seating unit of claim 24 further including rail means provided on opposite adjacent sides of said seat assembly for interconnecting said seat assembly to said carriage assembly and for supporting said seat assembly for reclining movement relative thereto, said rail means supporting said transverse drive rod and said manually operated actuation means, and wherein said manually operated actuating means comprises a handle pivoted on one of said rail means and having transfer linkage connecting said handle to said drive rod.

26. The reclining seating unit of claim 25 wherein said rail means supports a transversely extending support shaft extending through slots formed in side frame members of said seat member, said support shaft supporting said carriage assembly and said leg rest assembly when said seat assembly is moved to its forward-tilted and reclined positions, said slots adapted to coact with said swing link means for limiting the translational movement of said seat member upon independent reclining movement thereof.

27. The reclining seating unit of claim 26 wherein movement of said carriage assembly relative to said track means rotates said drive rod and wherein said leg rest assembly is operatively connected to said drive rod so that forward movement of said carriage assembly rotates said drive rod to elevate said leg rest assembly and wherein a rearwardly directed force applied to said leg rest assembly acts to move it to said retracted position which correspondingly rotates said drive rod for moving said carriage assembly to its rear-upright position until said first linkage means locks said drive rod in said first locked position.

* * * * *

UNITED STATES PATENT AND TRADEMARK OFFICE

CERTIFICATE OF CORRECTION

PATENT NO. : 5,147,108

DATED : September 15, 1992

INVENTOR(S) : Larry P. LaPointe

It is certified that error appears in the above-identified patent and that said Letters Patent is hereby corrected as shown below:

Col. 14, line 43, Claim 8

"link" should be --link- --.

Col. 16, line 3, Claim 15

"arrange" should be --arranged--.

Col. 16, line 36, Claim 15

"tiling sand" should be --tilting and--.

Col. 17, line 4, Claim 20

After "toward" insert --said forward-tilted position and said leg rest assembly for movement toward--.

Col. 17, line 20, Claim 22

"goggle" should be --toggle--.

UNITED STATES PATENT AND TRADEMARK OFFICE

CERTIFICATE OF CORRECTION

PATENT NO. : 5,147,108

DATED : September 15, 1992

INVENTOR(S) : Larry P. LaPointe

It is certified that error appears in the above-identified patent and that said Letters Patent is hereby corrected as shown below:

Col. 17, line 27, Claim 22

"rotated" should be --rotates--.

Col. 17, line 38, Claim 23

"i" should be --is--.

Col. 18, page 6, Claim 24 delete "front".

Col. 17, line 44, Claim 24
After "including" insert --a--.

Signed and Sealed this

Eighteenth Day of January, 1994

Bruce Lehman

*Attest:*

BRUCE LEHMAN

*Attesting Officer*

*Commissioner of Patents and Trademarks*